US007364521B2

(12) United States Patent
Yang

(10) Patent No.: US 7,364,521 B2
(45) Date of Patent: Apr. 29, 2008

(54) SUCKER WITH AN ANNULAR PROJECTION ON ADHESION SURFACE AND ADHESION ARROW HAVING THE SUCKER

(76) Inventor: Tae-Seong Yang, 104-1103, Daewon A.P.T., 30, Won-dong, Osani-si, Gyeonggi-do (KR) 447-734

( * ) Notice: Subject to any disclaimer, the term of this patent is extended or adjusted under 35 U.S.C. 154(b) by 136 days.

(21) Appl. No.: 10/552,092

(22) PCT Filed: May 23, 2003

(86) PCT No.: PCT/KR03/01019

§ 371 (c)(1),
(2), (4) Date: Jan. 3, 2006

(87) PCT Pub. No.: WO2004/088236

PCT Pub. Date: Oct. 14, 2004

(65) Prior Publication Data

US 2006/0135298 A1 Jun. 22, 2006

(30) Foreign Application Priority Data

Apr. 4, 2003 (KR) ..... 10-2003-0021257

(51) Int. Cl.
*A63B 65/02* (2006.01)
*F16B 47/00* (2006.01)

(52) U.S. Cl. ..... 473/578; 473/572; 473/582; 248/206.2; 248/362; 248/363

(58) Field of Classification Search ..... 248/206.2, 248/362, 363; 473/572, 578, 582
See application file for complete search history.

(56) References Cited

U.S. PATENT DOCUMENTS 873,628 A * 12/1907 Stivers ..... 473/578
1,298,139 A * 3/1919 Wolcott ..... 248/206.2
1,842,383 A * 1/1932 Bell ..... 248/206.2
2,888,004 A * 5/1959 Steiner ..... 124/27
3,162,444 A * 12/1964 Jackson et al. ..... 473/572
3,514,065 A * 5/1970 Donaldson et al. ..... 248/363
3,841,635 A * 10/1974 Wilson ..... 473/572
3,859,977 A * 1/1975 Lange ..... 124/66
3,954,266 A 5/1976 Carrano
3,997,162 A 12/1976 Scullin
4,537,176 A 8/1985 Stravitz

* cited by examiner

*Primary Examiner*—John A. Ricci
(74) *Attorney, Agent, or Firm*—Volpe And Koenig, PC

(57) ABSTRACT

The present invention relates to a sucker and an adhesion arrow having the same. More particularly, the present invention provides a sucker that can be attached, instead of a needle, to an arrow for a toy arrow shooter. The sucker of the present invention is formed with an annular projection on an adhesion surface of the sucker. Thus, even when the sucker collides against a target at a high speed, the sucker can be prevented from bouncing back from the target due to a repulsive force generated from the collision and thus securely adhere to the target. Further, even though the sucker of the present invention flies and collides against the target at a certain angle, the sucker can easily adhere to the target. Further, the sucker is made of a soft material so that a repulsive force can be smaller than an adhesion force when the sucker collides against the target. When a user shoots the adhesion arrow of the present invention by blowing it received in a shooting tool, the sucker is not caught by an inner circumferential surface of the tubular shooting tool so that the adhesion arrow of the present invention can be easily shot.

6 Claims, 14 Drawing Sheets

SUCKER WITH AN ANNULAR PROJECTION ON ADHESION SURFACE AND ADHESION ARROW HAVING THE SUCKER

TECHNICAL FIELD

The present invention relates to a sucker and an adhesion arrow having the sucker, and more particularly, to a sucker with an annular projection formed on an adhesion surface thereof for adhering while absorbing stepwise an impact generated when it collides against and adheres on an object, and an adhesion arrow having the sucker.

BACKGROUND ART

As shown in FIGS. 14 and 15, a conventional toy arrow shooter comprises an arrow 2 including a funnel-shaped air propulsion member 2*b* and a needle 2*a* attached to a front end of the air propulsion member 2*b*; and a tubular shooting tool 1 for shooting the arrow through blowing. Such a toy arrow shooter is a plaything in which an arrow is shot to hit a destination or target (not shown). However, since the arrow 2 used in the toy arrow shooter is provided with the needle 2*a*, this may be very dangerous if a user wrongly aims at a target so that the arrow is shot toward a person.

In order to eliminate this drawback, there has been proposed a toy arrow shooter comprising an arrow 10 having a magnetic 12, instead of a needle, which is fixed to a front end thereof and a shooting tool 20 as shown in FIGS. 16 and 17. In the arrow 10 to which the magnetic is fixed, as shown in FIGS. 16 and 17, a magnetic fixing member 13 to which the magnetic 12 is fixed is secured on an end portion of an air propulsion member 11 having a funnel-shaped recess. In a case where a user plays with the toy arrow shooter, the arrow to which the magnetic is fixed adheres to a metallic target 30.

However, since a front portion of the arrow 10 to which the magnetic is fixed is heavy, a flight distance thereof is short and the arrow does not adhere well to the target 30 due to a repulsive force generated when the arrow collides against the target. If the arrow is shot toward a weak body part such as a person's face, there is a risk of an injury of the body part since the arrow is heavy due to the attached magnetic 12.

Further, FIGS. 18 and 19 show a projectile 50 for use in a conventional toy gun for children The projectile 50 comprises a sucker 51 and a column 52 extending backward from a back surface of the sucker 51 in a predetermined length and having a "+"-shaped cross section. The projectile 50 is shot from a toy gun and adheres to a target 60 having a smooth surface by means of the sucker 51.

Referring to FIGS. 19(A) to (E), however, such a conventional sucker attached to the projectile for the toy gun has the following problem. A peripheral portion 53 of the sucker is deformed backward as shown in FIG. 19(B) if the projectile 50 is shot at a high speed and collides against the target 60. Then, the deformed peripheral portion 53 of the sucker 51 is restored toward the target 60 as shown in FIG. 19(C), and subsequently, an adhesion surface (inner surface of a circular arc) of the sucker 51 is detached from the target 60 due to a repulsive force generated when the peripheral portion 53 secondarily collides against the target 60, as shown in FIG. 19(D). The sucker 51 then bounces back from the target 60 so that the projectile does not adhere to the target as shown in FIG. 19(E). Moreover, since a peripheral portion of a back surface of the sucker 51 for use in the conventional projectile is formed to define a cylindrical surface in an axial direction, if the sucker flying toward and colliding against the target does not collide vertically against the target 60 but collides against the target at a certain angle, the peripheral portion of the back surface of the sucker is deformed inwardly toward the adhesion surface of the sucker, thereby causing a problem in that the sucker cannot adhere to the target. Furthermore, since the sucker 51 for use in the conventional projectile is made of a hard resin, in case of a small-sized sucker, a repulsive force that is larger than an adhesion force of the sucker is generated when the peripheral portion is restored as shown in FIGS. 19(B) and (C). Thus, the conventional projectile has a problem in that the sucker 51 cannot adhere well to the target 60. In addition, the toy gun for using the projectile to which the conventional sucker is attached is expensive and gets frequently out of order, so that the toy gun cannot be used for a long time.

DISCLOSURE OF INVENTION

An object of an aspect of the present invention is to solve the aforementioned problems of the conventional sucker and to provide a sucker that can be attached, instead of a needle, to an arrow for use in a toy arrow shooter. In particular, the sucker of the present invention comprises an annular projection on an adhesion surface of the sucker. Thus, even when the sucker collides against a target at a high speed, the sucker can be prevented from bouncing back from the target due to a repulsive force generated from the collision and thus securely adhere to the target. Further, even though the sucker of the present invention flies and collides against the target at a certain angle, the sucker can easily adhere to the target. In addition, the sucker of the present invention is made of a soft material such that even though the sucker has a small size, a repulsive force becomes smaller than an adhesion force when the sucker collides against the target.

Another object of the present invention is to provide an arrow for a toy arrow shooter (hereinafter, refer to as "adhesion arrow"), which is an arrow for a shooter enabling the arrow to be shot through blowing, has the aforementioned sucker instead of a needle and can fly over a long distance. In particular, when a user shoots the adhesion arrow of the present invention by blowing it received in a shooting tool, the sucker is not caught by an inner circumferential surface of the tubular shooting tool so that the adhesion arrow of the present invention can be easily shot.

A sucker for an adhesion arrow according to an aspect of the present invention comprises a dome-shaped adhesion portion made of a flexible material having the resiliency, the adhesion portion including an adhesion surface having a concave shape and a substantially circular boundary to generate a vacuum when the adhesion surface comes into hermetical contact with the flat surface and then is restored to the original shape by the resiliency, and an annular projection protruding by a predetermined width and height from the adhesion surface along a position with a predetermined radius from the center of the adhesion surface; and a fixing portion extending from a back surface of the adhesion portion.

Further, the sucker according to the aspect of the present invention may further comprise an inclined surface extending from a boundary of the adhesion surface to a boundary of the back surface such that the diameter of a cross section of the sucker increases to have the shape of a truncated cone, thereby absorbing the impact when the adhesion surface comes into contact with the flat surface.

In the sucker according to the aspect of the present invention, the flexible material having the resiliency may be a silicone resin.

The sucker according to the aspect of the present invention may further comprise an annular projection formed on an outer circumferential surface of the fixing portion.

An adhesion arrow according to another aspect of the present invention comprises the sucker with the annular projection formed on the adhesion surface according to the above aspect of the present invention; and an air propulsion member including a sucker fixing portion having a sucker fixing hole formed in a face of an end thereof to fixedly receive the fix&g portion of the sucker, and a propulsion vane portion having the shape of a hollow funnel of which the diameter increases towards the other end of the sucker fixing portion.

The adhesion arrow according to the other aspect of the present invention may further comprise a sucker supporting member including a circular ring portion fixedly fitted around an outer circumferential surface of the sucker fixing portion of the air propulsion member and supporting portions formed on an outer circumferential surface of the ring portion at a predetermined angular interval. Each of the supporting portions protrudes by a predetermined length and width in an axial direction and in a direction perpendicular thereto. The length from the center of the supporting portion to the tip thereof is longer than the radius of the adhesion portion of the sucker but shorter than a largest diameter of the propulsion vane portion of the air propulsion member.

Figure 1:
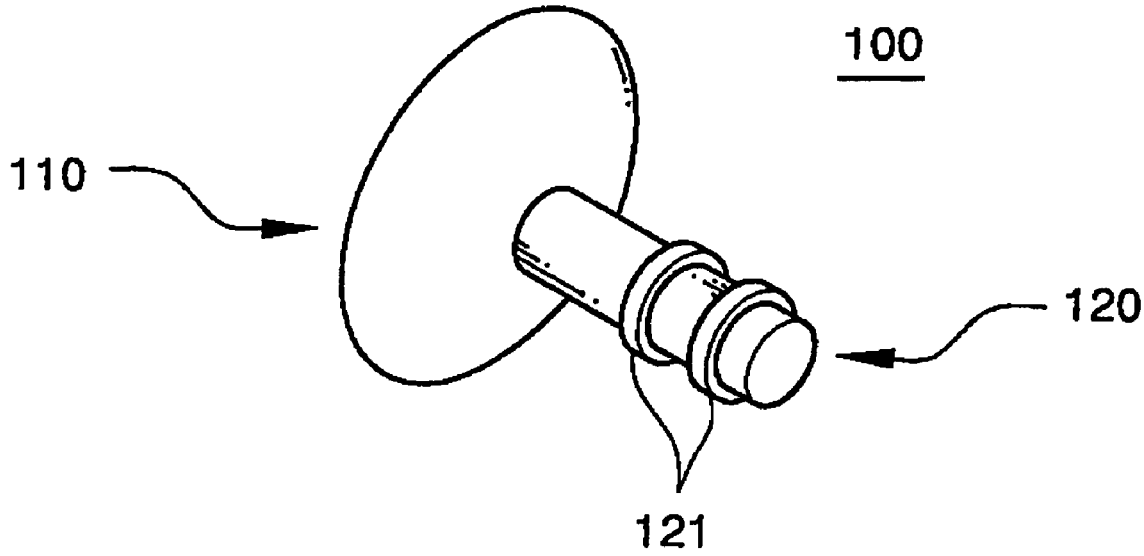
FIG. 1 is a perspective view of an embodiment of a sucker having an annular projection formed on an adhesion surface according to an aspect of the present invention.

100: Sucker
110: Adhesion portion
111: Adhesion surface
113: Annular projection
114: Largest circumference portion of adhesion portion
120: Fixing portion
121: Locking projection
200: Air propulsion member
211: Propulsion vane portion
212: Sucker fixing portion
300: Shooting tool
310: Barrel portion
320: Extension portion
400: Sucker supporting member

BEST MODE FOR CARRYING OUT THE INVENTION

Hereinafter, preferred embodiments of the present invention will be described in detail with reference to accompanying drawings.

Figure 2:
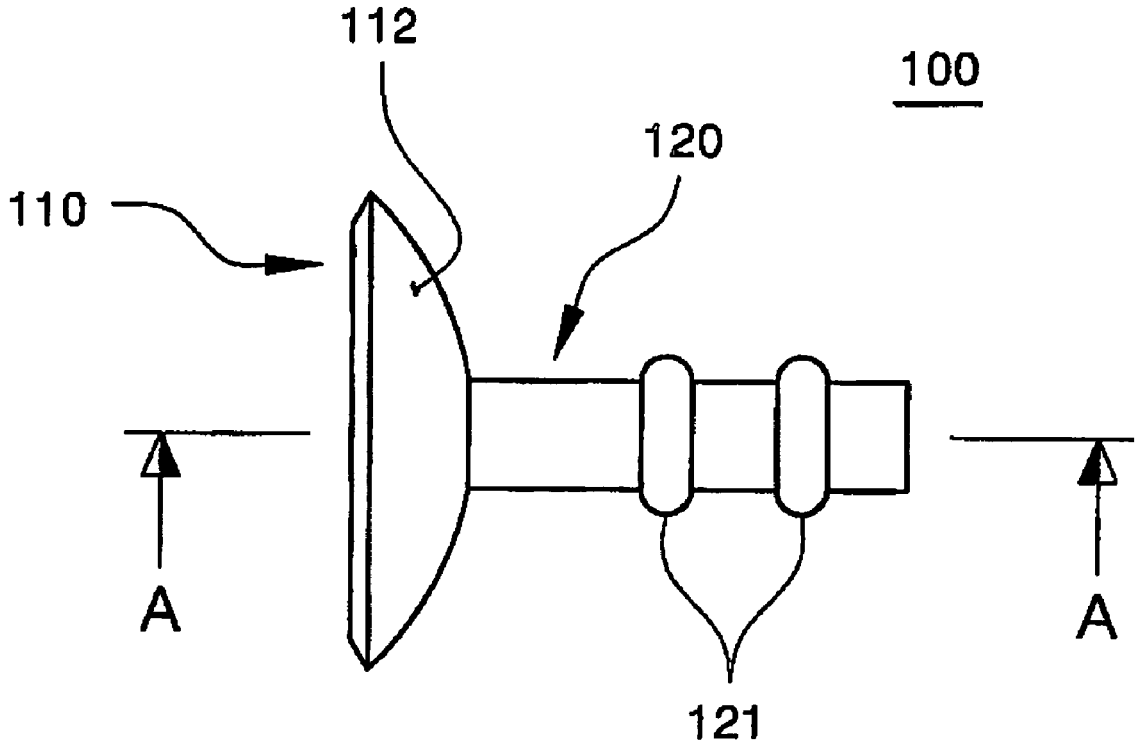
FIG. 2 is a front view of the sucker shown in FIG. 1.
Figure 3:
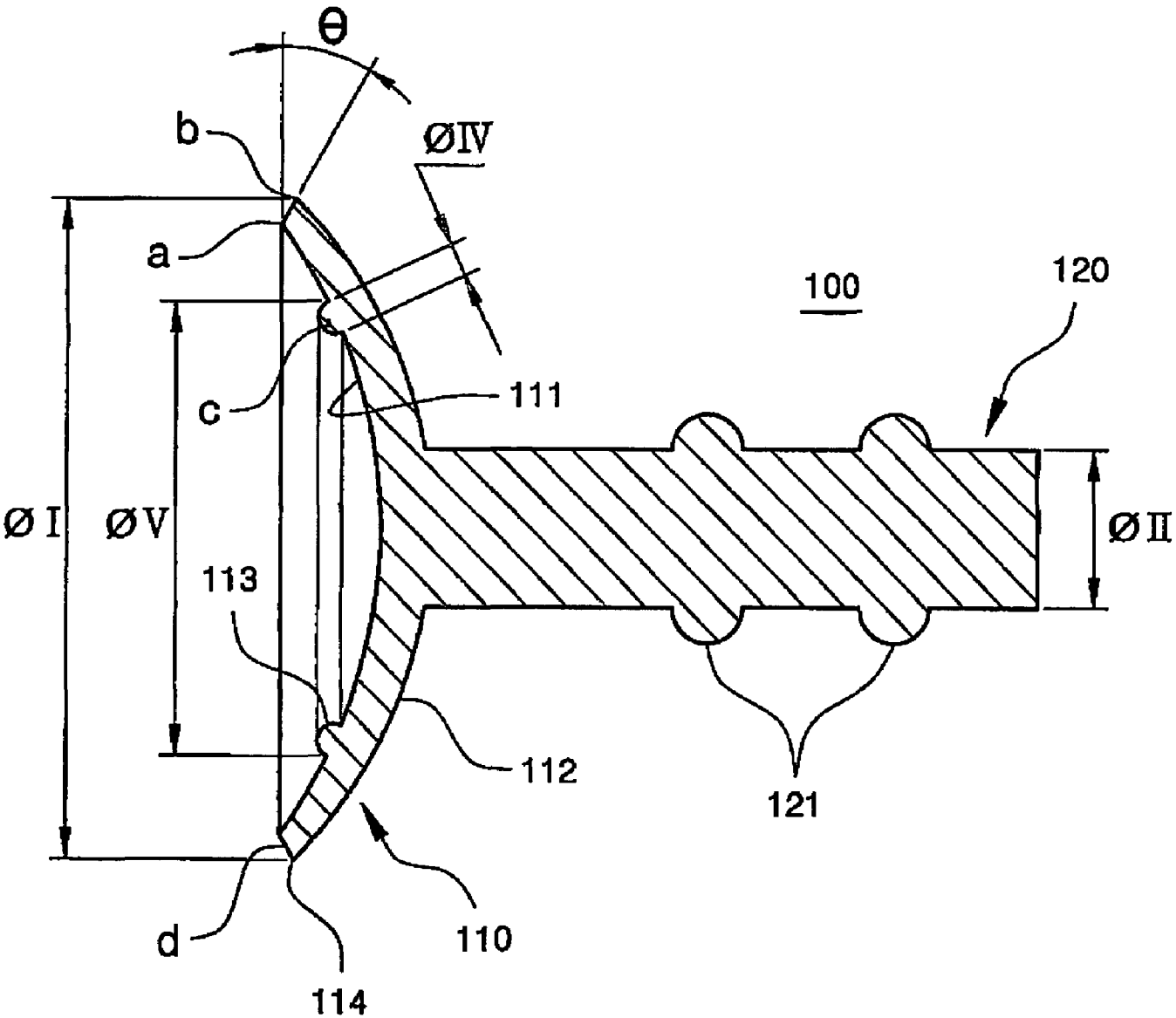
FIG. 3 is a sectional view taken along line A-A in FIG. 2.

FIG. 1 is a perspective view of an embodiment of a sucker having an annular projection formed on an adhesion surface according to an aspect of the present invention, FIG. 2 is a front view of the sucker shown in FIG. 1, and FIG. 3 is a sectional view taken along line A-A in FIG. 2.

A sucker 100 according to an aspect of the present invention comprises a dome-shaped adhesion portion 110 and a zing portion 120. The adhesion portion 110 is made of a flexible material having resiliency so that a vacuum state is formed between an adhesion surface of the adhesion portion and a flat surface when the adhesion portion comes into hermetical contact with the flat surface and is then restored. The fixing portion 120 extends to protrude from a back surface 112 of the adhesion portion. As can be seen from the FIG. 3, the adhesion portion 110 has the adhesion source 111 formed at a side thereof and having a circular boundary and a concave shape. In order to absorb an impact generated when the sucker comes into contact with an object, an annular projection 113 having a predetermined width and height is formed along a position with a predetermined radius from the center of the adhesion surface 111 on the adhesion surface 111.

Further, the fixing portion 120 takes the shape of a cylinder having a predetermined diameter and extending from the center of a back surface of the adhesion portion 110. Particularly, the fixing portion 120 has locking projections 121 formed on an outer circumferential surface thereof. The sucker 100 is inserted into an air propulsion member of an adhesion arrow according to another aspect of the present invention and then fixed in the air propulsion member by the locking projections. It is preferred that a plurality of locking projections be formed on the outer circumferential surface of the fixing portion at a regular interval in the form of a protruding circular band.

Moreover, it is preferred that the sucker 100 be made of silicone resin that is one of flexible materials having resiliency. When the sucker 100 made of the soft silicone resin collides against a target at a high speed, a peripheral portion 114 of the adhesion surface 111 of the sucker 100 is deformed toward the back surface and then restored to an original shape. At this time, a repulsive force of the sucker against the target is smaller than an adhesion force so that the sucker is prevented from bouncing from the target Thus, the sucker 100 can adhere well to the target. Further, the annular projection 113 formed on the adhesion surface 111 of the sucker 100 alleviates an impact generated when the adhesion surface 111 collides against the target and performs the function of limiting a range in which the peripheral portion 114 of the adhesion surface 111 is deformed backward, thereby enabling the sucker 100 to securely adhere to the target. Accordingly, when the adhesion surface 111 collides against the target, a part of the adhesion surface located inside the annular projection 113 adheres primarily, and then, the peripheral portion deformed backward upon collision thereof is restored and adheres secondarily to the target, so that the sucker 100 can securely adhere to the target. That is, when the sucker 100 collides against the target at a high speed, portion "a" shown in FIG. 3 first collides against the target and a part of the adhesion portion 110 outside the annular projection 113 (part between the diameters of θ V and θ I) is deformed to primarily absorb the impact. Thereafter, the annular projection 113 collides secondarily against the target while resisting the deformation, and the part of the adhesion surface located inside the annular projection 113 adheres to the target. Then, the deformed part of the adhesion portion outside the annular projection 113 is restored and comes into close contact with the target.

In addition, in the sucker 100 of the present invention, an inclined surface d in the form of a truncated cone is provided at the peripheral portion to extend from a boundary a of the adhesion surface 111 to a boundary b of the back surface 112 while the diameter of a cross section of the sucker 100 gradually increases. That is, as shown in FIG. 3, a surface connecting the largest circumference a of the adhesion surface 111 of the adhesion portion 110 to the largest circumference b of the back surface 112 is inclined at a predetermined angle θ, preferably an acute angle with respect to a plane (i.e., the surface of the target) defined by the largest circumference a of the adhesion surface 111. Accordingly, if the sucker 100 flies and collides against the target at a certain angle rather than at a right angle, the inclined surface prevents the peripheral portion of the sucker from being deformed toward the adhesion surface 111 of the sucker 100, thereby improving the reliability of adhesion of the sucker to the target. That is, if the sucker 100 does not collide against the target at the right angle, the inclined surface d serves to correct a flight angle so that the sucker 100 can adhere well to the target. The inclined surface also performs the function of partially absorbing the impact applied to the sucker when the sucker comes into contact with the target.

In this embodiment, the diameter θ I of the adhesion portion 110 is 13 to 14 mm, the diameter θ II of the fixing portion 120 is 3.5 mm, and the width θ IV of the annular projection 113 forming a circular band is 1.0 mm. Further, the diameter θ V of the circular band formed by the annular projection 113 is 9.5 to 11.0 mm, the thickness of the adhesion portion 100 is about 1.0 mm. Moreover, the fixing portion 120 of the sucker 100 of the present invention has a length suitable for inserting and fixing it into and to an air propulsion member 200.

Figure 4:
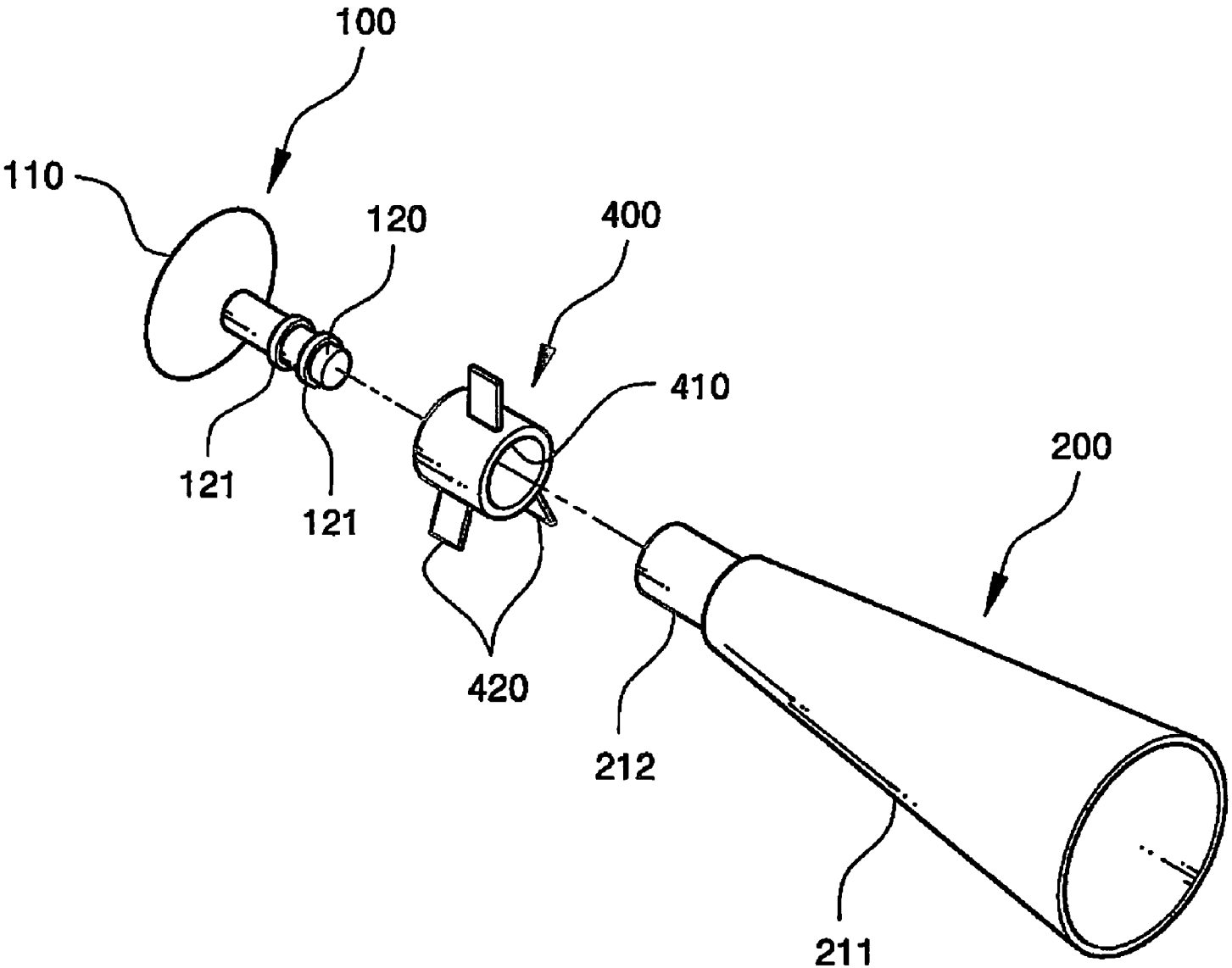
FIG. 4 is an exploded perspective view showing an embodiment of an adhesion arrow having the sucker according to another aspect of the present invention.
Figure 5:
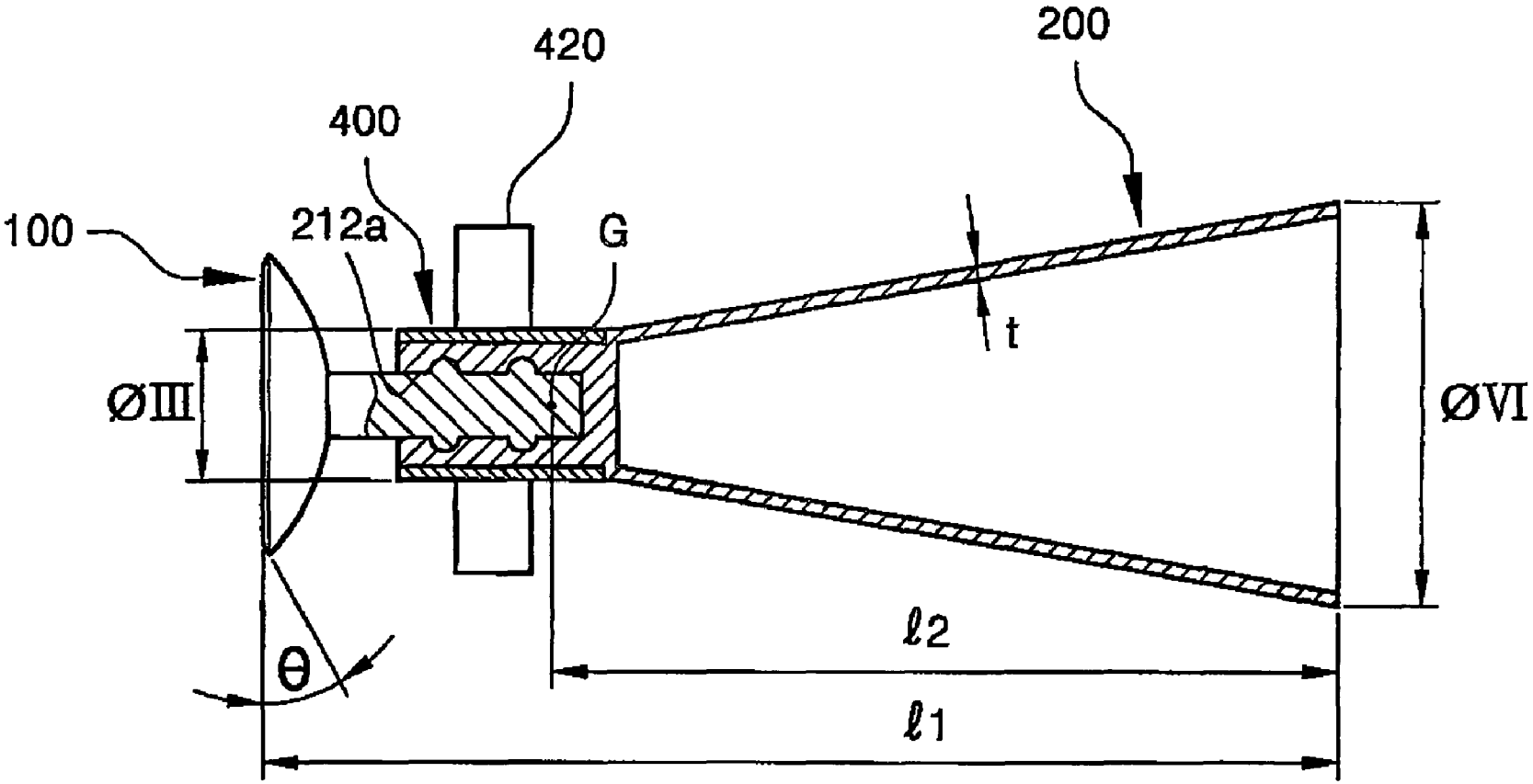
FIG. 5 is a partially sectional view showing a state where the adhesion arrow of FIG. 4 is assembled.
Figure 6:
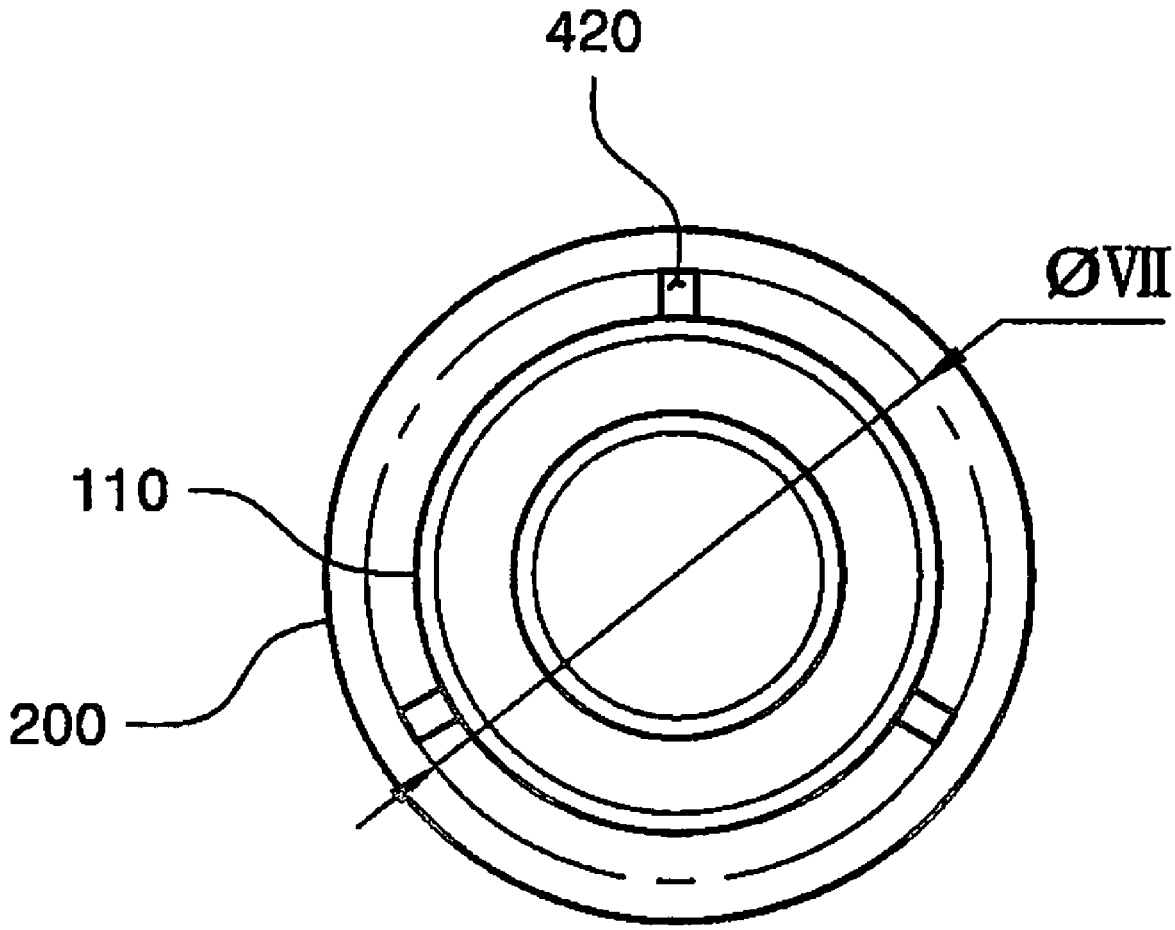
FIG. 6 is a left side view of FIG. 5.

FIG. 4 is an exploded perspective view showing an embodiment of an adhesion arrow having the sucker according to another aspect of the present invention, FIG. 5 is a partially sectional view showing a state where the adhesion arrow of FIG. 4 is assembled, and FIG. 6 is a left side view of FIG. 5.

As shown in FIG. 4, a preferred embodiment of an adhesion arrow according to another aspect of the present invention comprises the sucker 100 having the annular projection formed on the adhesion surface, and a funnel-shaped air propulsion member 200 to which the fixing portion 120 is coupled. The air propulsion member 200 is provided with a sucker fixing portion 212 and a propulsion vane portion 211 having the shape of a hollow funnel. The sucker fixing portion 212 has a hole formed at an end thereof such that the fixing portion 120 of the sucker 100 is fixedly received in the hole. The propulsion vane portion 211 extends from the other end of the sucker fixing portion 212 while its diameter gradually increases. Although the propulsion vane portion 211 has the shape of a hollow truncated cone (funnel) in this embodiment, it may have the shape of any polygonal (more than octagonal) funnel. Further, it is preferred that the adhesion arrow further comprise a sucker supporting member 400 which is fixedly fitted around an outer circumferential surface of the sucker fixing portion 212 of the air propulsion member 200. The sucker supporting member 400 comprises a circular ring portion 410 and a plurality of supporting portions 420 formed on an outer circumferential surface of the ring portion 410 at a predetermined angular interval. Each of the supporting portions 420 having a predetermined width and length protrudes perpendicularly to an axial direction of the ring portion 410. In particular, to prevent the adhesion portion 110 from being hindered due to contact with an inner circumferential surface of a shooting tool 300 when the sucker is shot from the shooting tool 300, the length form the center of axis of the sucker supporting portion 420 to a tip end is longer than the radius of the adhesion portion 110 from the center of axis but shorter than the maximum diameter of the propulsion vane portion 211 of the air propulsion member 200. That is, the supporting portions 420 of the sucker supporting member 400 having a predetermined length protrude from the outer circumferential surface of the circular ring portion 410 at the predetermined angular interval perpendicularly to the axial direction of the sucker supporting member, so that the end of each supporting portion 420 is in contact with and slid on an inner circumferential surface of the shooting tool 300 when the adhesion arrow is shot. Accordingly, his structure enables the adhesion arrow to be shot from the shooting tool in a state where the sucker of the adhesion arrow is not in contact with the inner circumferential surface of the shooting tool. Each of the locking projections 121 formed on the outer circumferential surface of the fixing portion 120 of the sucker 100 is received in a corresponding one of annular grooves formed on an inner circumference of the sucker fixing portion 212 of the air propulsion member 200 around which the circular ring portion 410 is fitted. At this time, the inner circumference of the sucker fixing portion 212 defines the sucker fixing hole 212*a*. However, the fixing portion 120 may be fixedly fitted into the sucker fixing portion 212 after applying an adhesive thereon.

In the adhesion arrow of this embodiment, the largest diameter θ I of the adhesion portion 110 is 13 to 14 mm, the largest diameter θ II of the fixing portion 120 is 3.5 mm, the diameter θ III of the sucker fixing portion 212 is 4.5 to 5.0 mm, the largest diameter θ VI of the propulsion vane portion 200 is 14.9 mm, and the diameter ϕ VII of the fixing portion is 14.5 mm. Further, the thickness t of the propulsion vane portion is 0.3 to 0.5 mm On the assumption that the total length 1 of the adhesion arrow is 1, a distance 2 between the center of gravity of the adhesion arrow and an end of the propulsion vane portion 211 of the air propulsion member 200 is 0.7 to 0.75. Due to such structure, a flight distance of the adhesion arrow can be maximized when a user inserts the adhesion arrow into the shooting tool 300 and then blows it.

Figure 7:
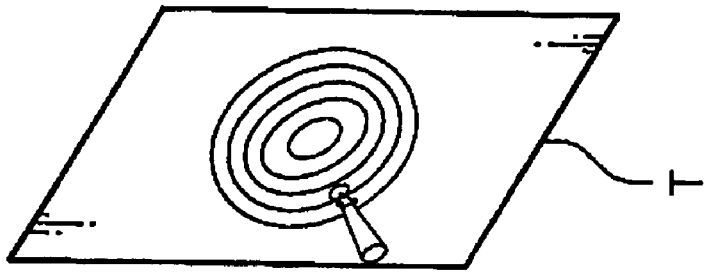
FIG. 7 is a view illustrating a state where a user combines a plurality of shooting tools for shooting the adhesion arrow of the present invention in series and shoots the adhesion arrow toward a target.
Figure 7:
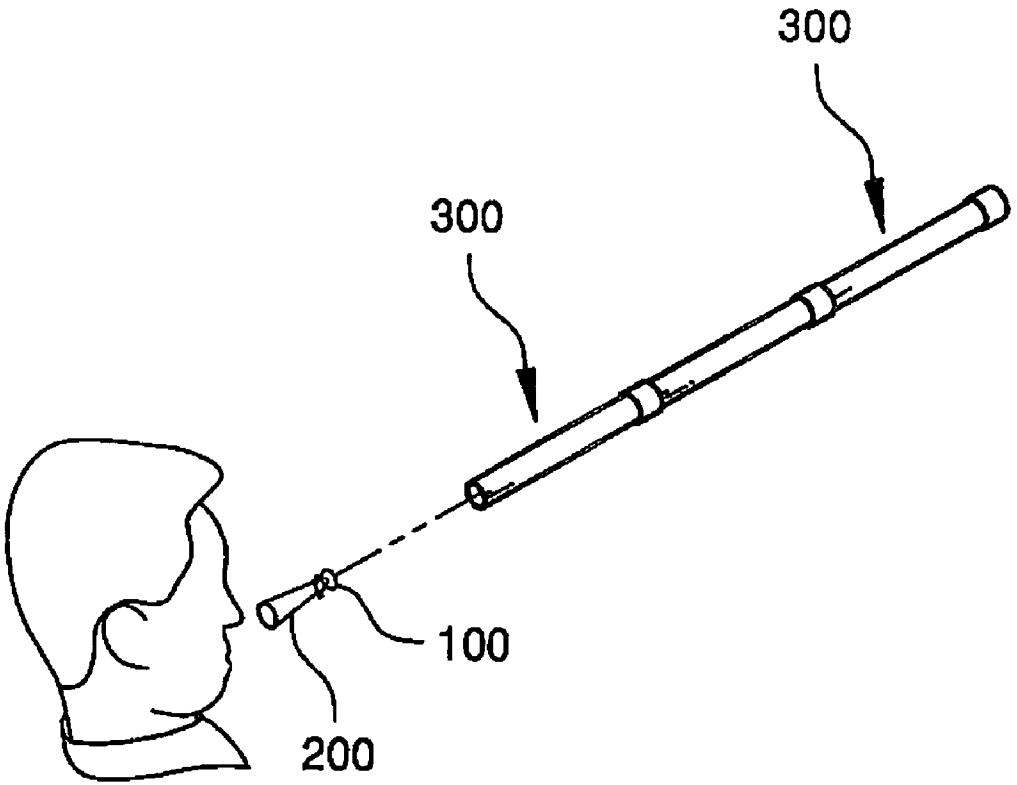
Figure 8:
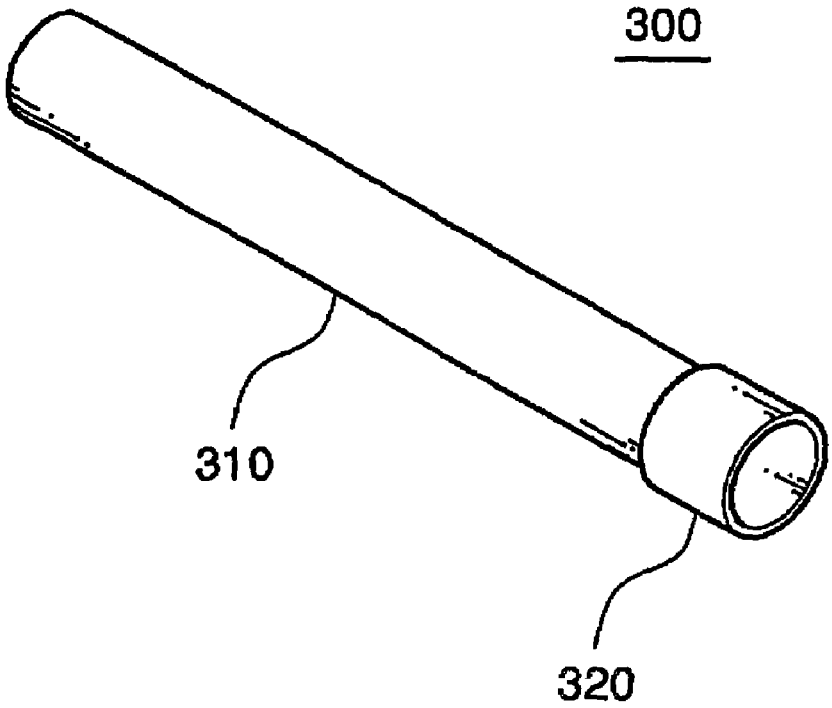
FIG. 8 is a perspective of the shooting tool of FIG. 7.
Figure 9:
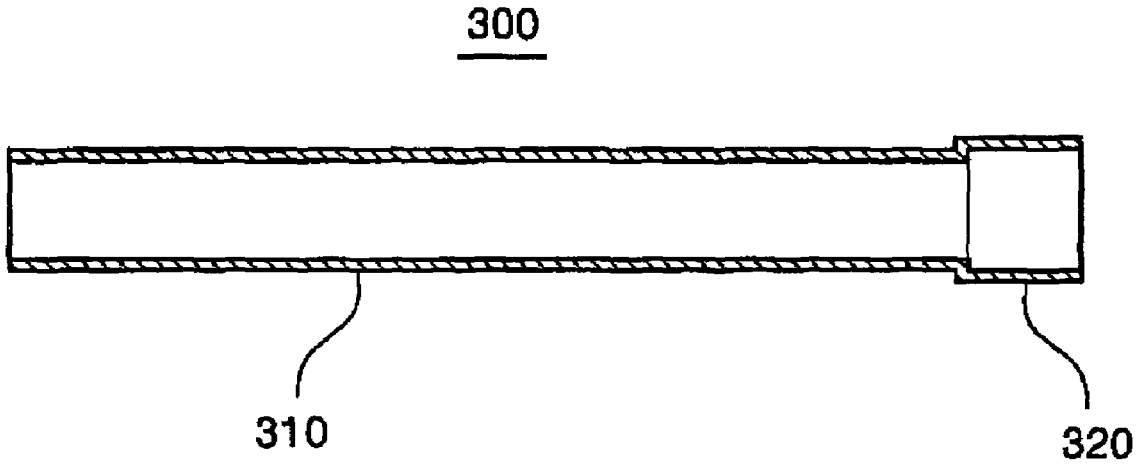
FIG. 9 is a longitudinal sectional view of FIG. 8.

FIG. 7 is a view illustrating a state where a user combines a plurality of shooting tools for shooting the adhesion arrow of the present invention in series and shoots the adhesion arrow toward a target, FIG. 8 is a perspective of the shooting tool of FIG. 7, and FIG. 9 is a longitudinal sectional view of FIG. 8.

According to a further aspect of the present invention, the shooting tool 300 for receiving and shooting the adhesion arrow through blowing is provided. As shown in FIG. 7, the adhesion arrow can be flown over a longer distance when the plurality of shooting tools 300 coupled to one another are used. As shown in FIGS. 8 and 9, each of the shooting tools 300 comprises a hollow cylindrical barrel portion 310 formed at an end thereof, and a barrel extension portion 320 formed integrally with the barrel portion 310 so that an end of a barrel portion of another shooting tool can be fitted into the barrel extension portion 320 to increase the entire length of the coupled shooting tools. The inner diameter of the barrel extension portion 320 is formed to be fitted to outer diameter of another barrel portion 310 so that the inner diameters of the two barrel portions coincide with each other.

Of course, although a step portion is formed due to a difference between the outer diameters of the barrel portion 310 and the barrel extension portion 320, the aforementioned structural conditions may also be satisfied even if the outer diameters of the barrel portion 310 and the barrel extension portion 320 are identical with each other. Further, a plurality of ribs may be formed along the length of each barrel portion 310 to prevent the barrel portion 310 from being bent when the plurality of shooting tools 300 are coupled to each other.

FIGS. 10(A) and (B) are side and front views showing another embodiment of an air propulsion member of the adhesion arrow of the present invention, and FIGS. 11(A) and (B) are side and front views showing a further embodiment of the air propulsion member of the adhesion arrow of the present invention.

Figure 10:
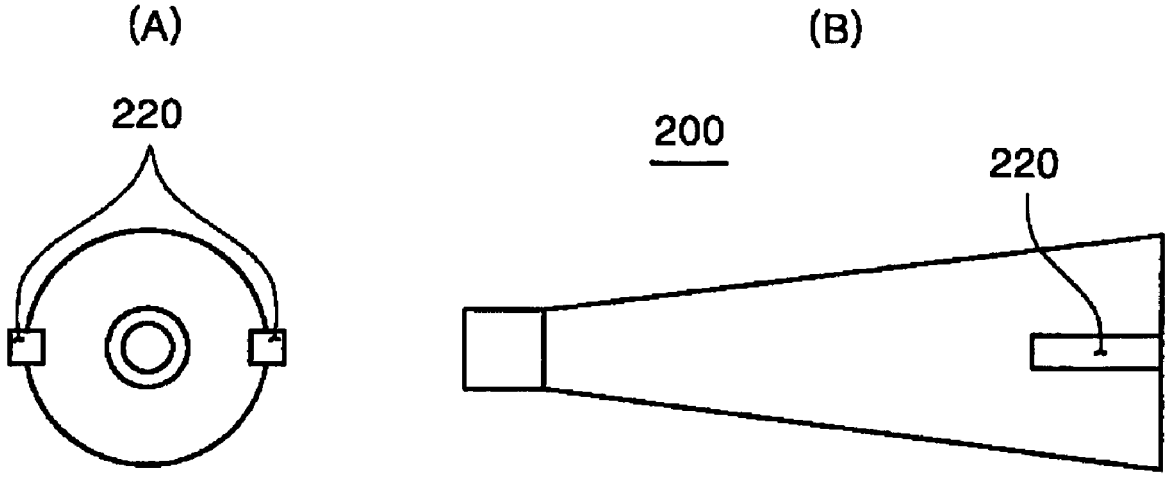
FIGS. 10(A) and (B) are side and front views showing another embodiment of an air propulsion member of the adhesion arrow of the present invention.
Figure 11:
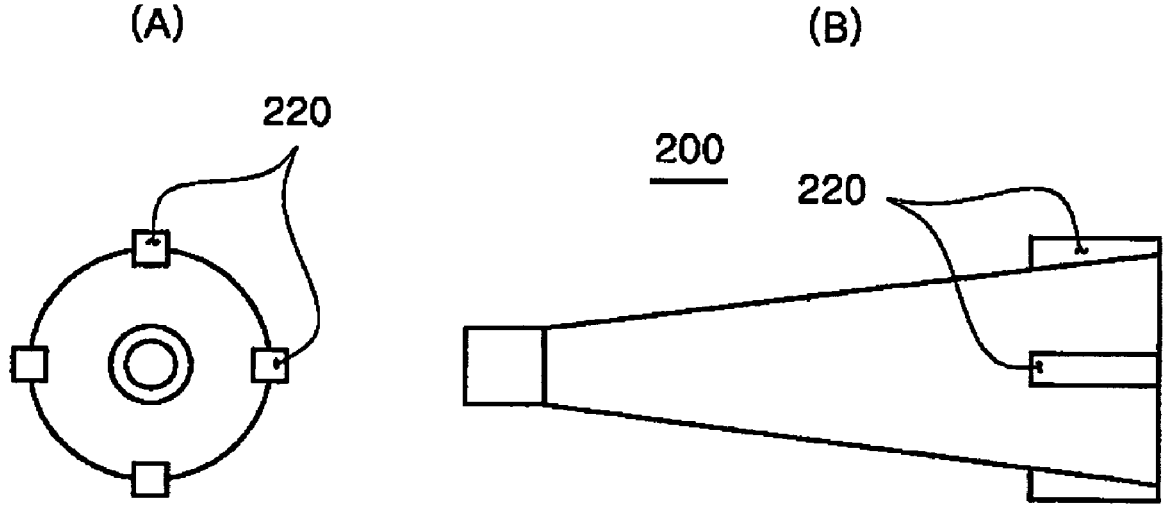
FIGS. 11(A) and (B) are side and front views showing a further embodiment of the air propulsion member of the adhesion arrow of the present invention.

As shown in FIGS. 10 and 11, projections 220 protrude by a predetermined length and height from an outer circumferential surface of a largest diameter portion of the air propulsion member 200 in an axial direction and in a direction perpendicular thereto. Therefore, when the adhesion arrow flies after being shot from the shooting tool 300, the adhesion arrow can accurately reach a target. On the other hand, if three or more projections 220 extending by a predetermined length in the axial direction while having a height flush with the largest circumference portion 114 of the adhesion portion 110 are formed on the outer circumferential surface of the largest diameter portion of the air propulsion member 200, it is possible to prevent the largest circumference portion 114 of the adhesion portion from being worn when the adhesion arrow is moved in the shooting tool 300 by air pressure.

FIGS. 12(A) and (B) are a longitudinal sectional view and a right side view showing a shooting tool corresponding to the air propulsion member of the adhesion arrow of FIG. 10, respectively; and FIGS. 13(A) and (B) are a longitudinal sectional view and a right side view showing a shooting tool corresponding to the air propulsion member of the adhesion arrow of FIG. 11, respectively.

Figure 12:
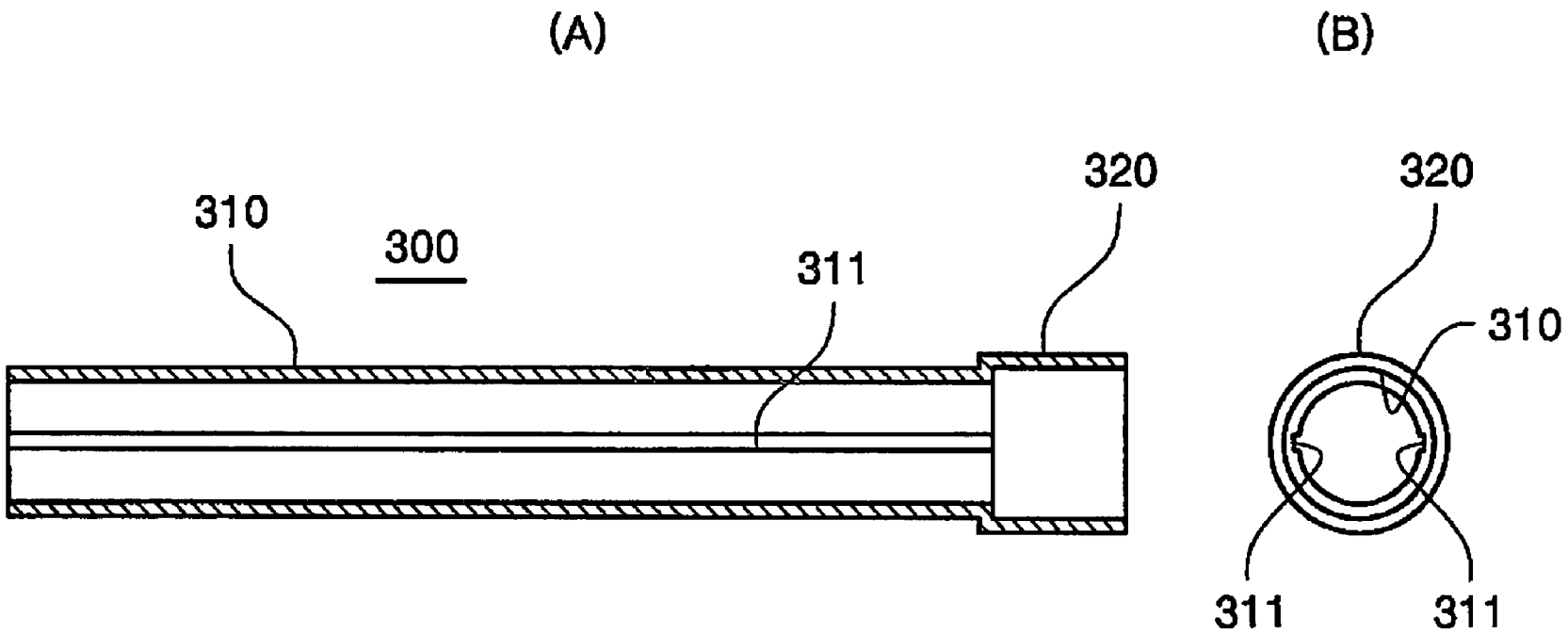
FIGS. 12(A) and (B) are a longitudinal sectional view and a right side view showing a shooting tool corresponding to the air propulsion member of the adhesion arrow of FIG. 10, respectively.
Figure 13:
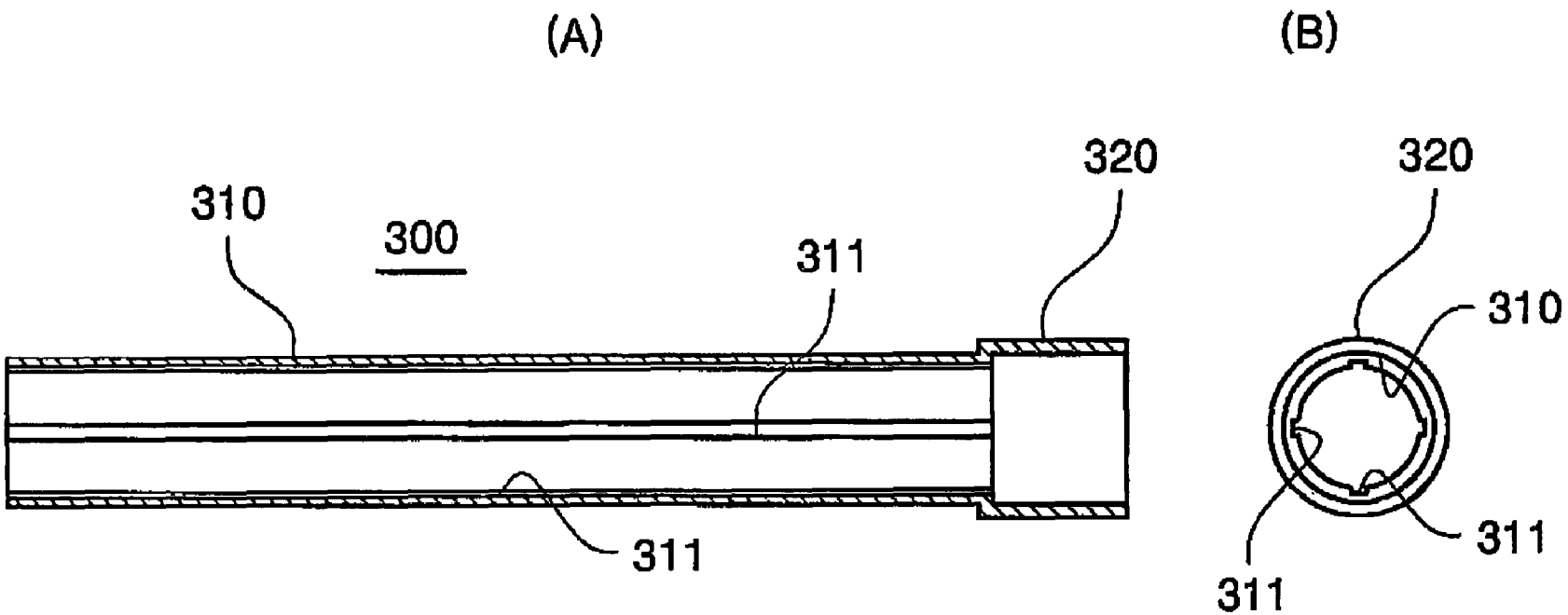
FIGS. 13(A) and (B) are a longitudinal sectional view and a right side view showing a shooting tool corresponding to the air propulsion member of the adhesion arrow of FIG. 11, respectively.
Figure 14:
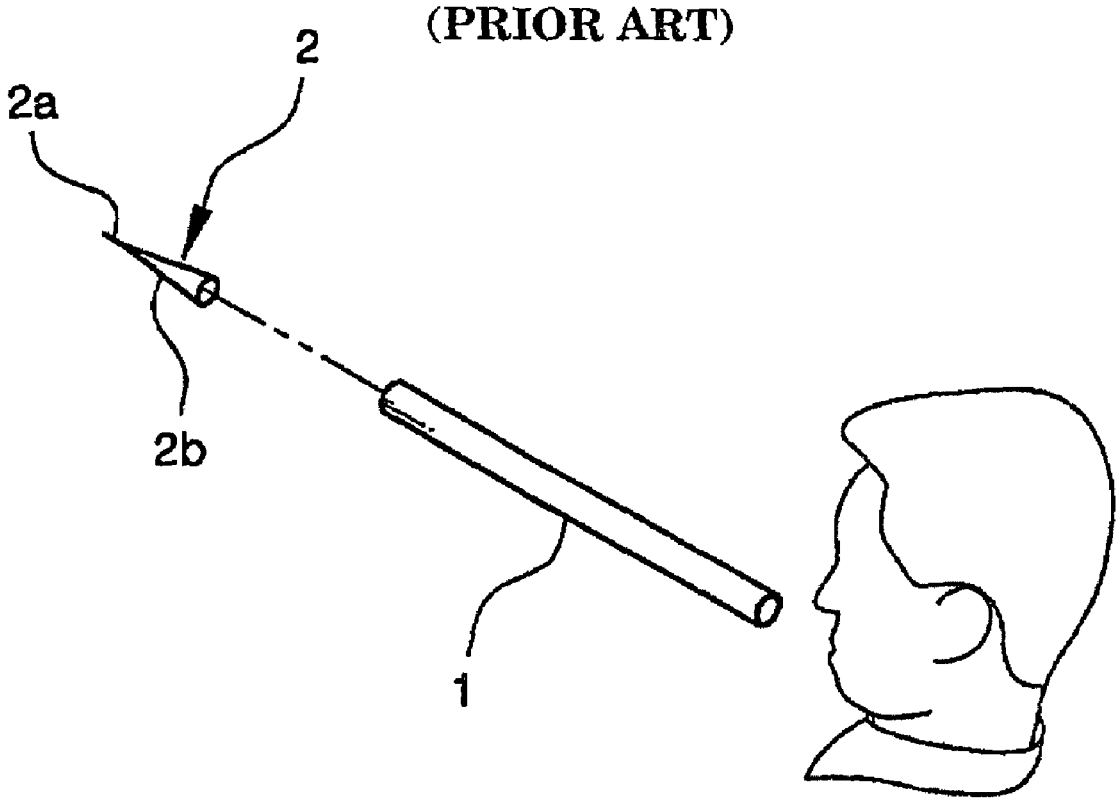
FIG. 14 (PRIOR ART)
FIG. 14 is a view illustrating a state where a conventional arrow having a needle is shot by a shooting tool.
Figure 15:
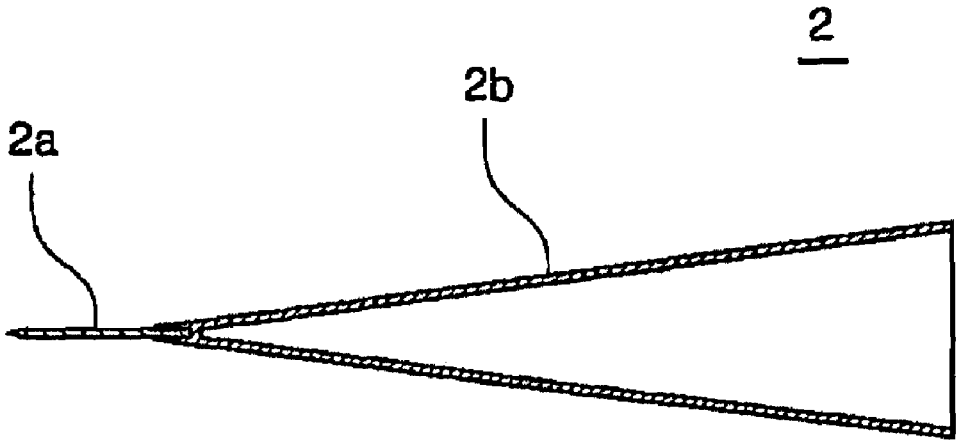
FIG. 15 (PRIOR ART)
FIG. 15 is a longitudinal sectional view of the arrow of FIG. 14.
Figure 16:
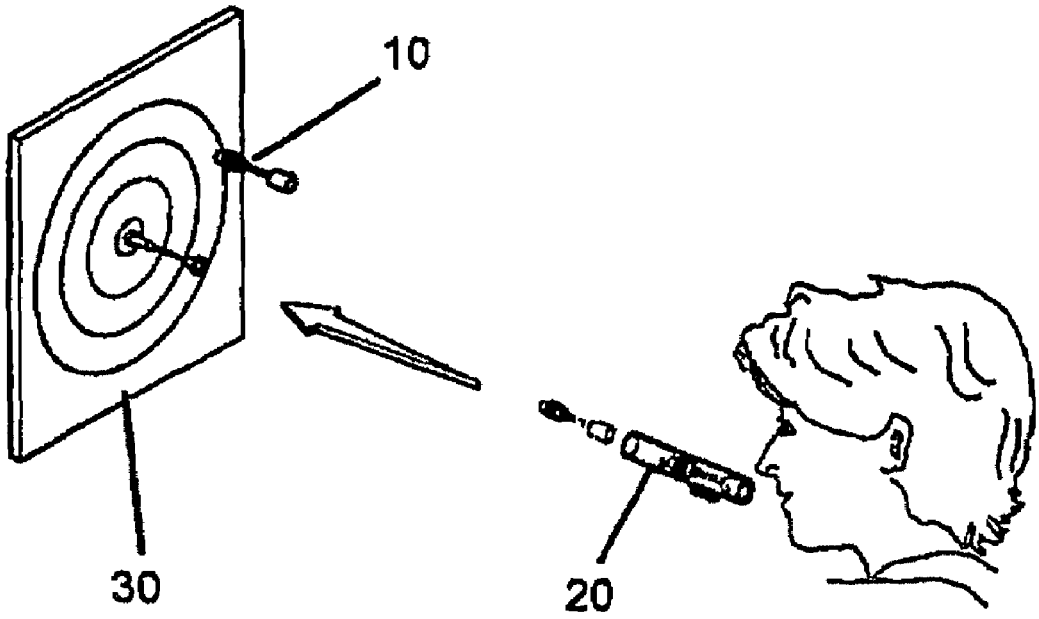
FIG. 16 (PRIOR ART)
FIG. 16 is a view illustrating a state where a conventional arrow having a magnetic is shot by a shooting tool.
Figure 17:
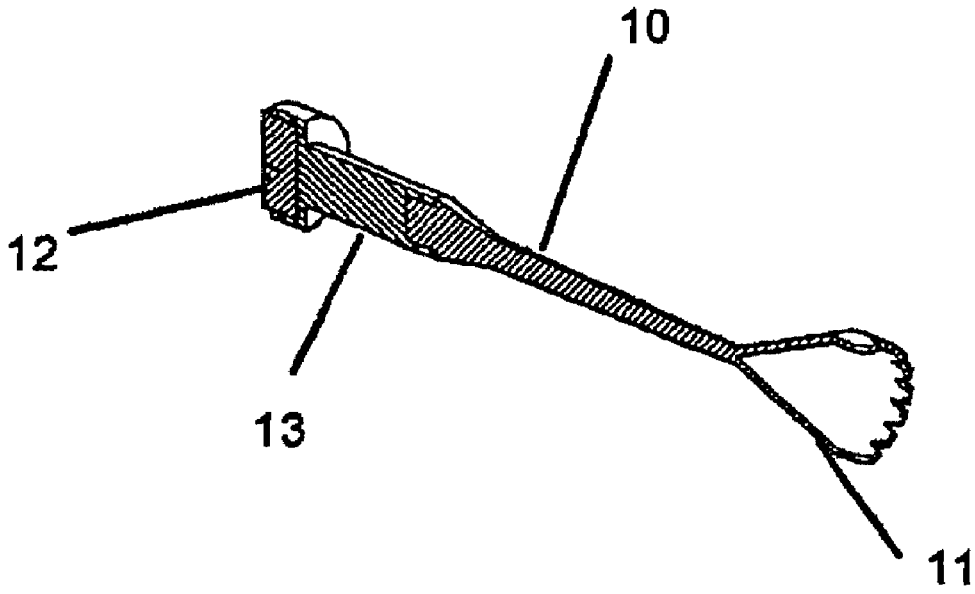
FIG. 17 (PRIOR ART)
FIG. 17 is a longitudinal sectional, perspective view of the arrow of FIG. 16.
Figure 18:
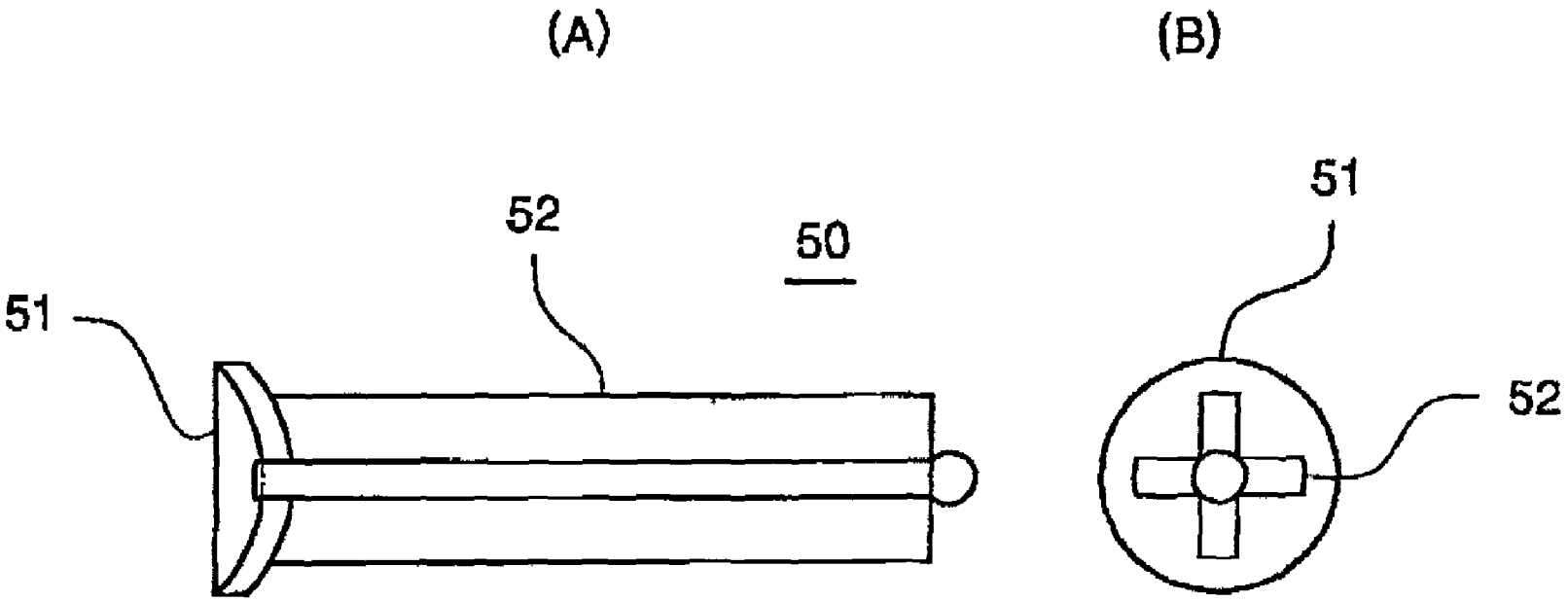
FIG. 18 (PRIOR ART)
FIGS. 18(A) and (B) are front and side views showing a conventional projectile provided with a sucker for use in a toy gun, respectively.
Figure 19:
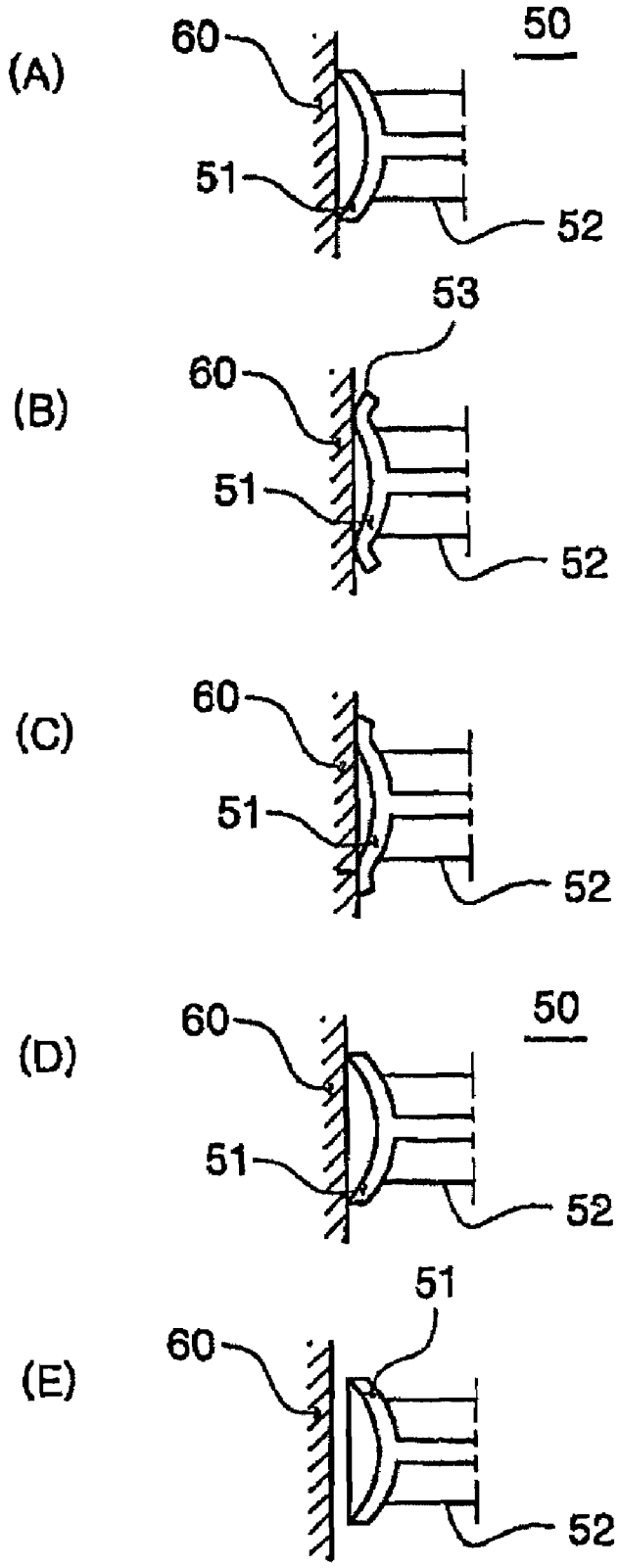
FIG. 19 (PRIOR ART)
FIGS. 19(A) to (E) are views illustrating states where the sucker of the conventional projectile is shot toward, adheres to and is then detached from a target

As shown in FIGS. 12 and 13, if the two projections 220 are formed on the outer circumferential surface of the air propulsion member 200 at an angular interval of 180 degrees as shown in FIG. 10, the barrel portion 310 of the shooting tool 300 has two guide grooves 311 formed on the inner circumferential surface thereof in the axial direction to correspond to the projections 220, and alternatively, if the four two protrusions 220 are formed on the outer circumferential surface of the air propulsion member 200 at an angular interval of 90 degrees, barrel portion 310 has four guide grooves 311 formed on the inner circumferential surface thereof in the axial direction to correspond to the projections.

Accordingly, when a user blows arid shoots the adhesion arrow of which the air propulsion member 200 is formed with the projections 220 within the shooting tool 300 provided with the guide grooves 311, the adhesion arrow is exactly flown and then adheres to the target.

INDUSTRIAL APPLICABILITY

According to an aspect of the present invention, there is provided a sucker that can be used in an arrow for a toy arrow shooter, instead of a needle, and has an annular projection formed on an adhesion surface thereof. Even though the sucker collides against a target at a high speed, the sucker is prevented from bouncing from the target due to a repulsive force generated upon collision thereof against the target so that it can securely adhere to the target. Therefore, it is possible to manufacture a safe sucker for a toy arrow shooter.

Since the sucker of the present invention has the annular projection in the form of a circular band formed at a predetermined position on the adhesion surface, once the adhesion arrow is shot toward the target at a high speed, a largest circumference portion of an adhesion portion of the sucker is deformed backward, the annular projection in the form of the circular band adheres to the target, and then, the largest circumference portion of the adhesion portion is restored and secondarily adheres to the target. Thus, the sucker has an advantage in that it can securely adhere to the target.

Further, the sucker is made of a soft silicone resin such that a surface inclined from a largest circumference of the adhesion surface, which adheres to the target, toward a back surface of the sucker at a certain angle is formed. Therefore, even though the sucker is made to have a small diameter, a repulsive force is weak and a flight angle is compensated by the inclined surface, thereby enabling the sucker to adhere to the target well.

In addition, the present invention has an advantage in that, by adding an air propulsion member to the sucker, a user can play safely using a tubular shooting tool.

According to another aspect of the present invention, there is provided an adhesion arrow with the sucker for a toy arrow shooter, wherein reliability of adhesion is improved and the arrow can be safely flown over a long distance.

Further, the adhesion arrow of the present invention has a sucker supporting member formed at an end of the air propulsion member. Therefore, the present invention has an advantage in that when the adhesion arrow is shot by the shooting tool, the sucker can be smoothly shot while it is not caught by an inner circumferential surface of the shooting tool.

It is intended that the embodiments of the present invention described above and illustrated in the drawings should not be construed as limiting the technical spirit of the present invention The scope of the present invention is defined only by the appended claims. Those skilled in the art can make various changes and modifications thereto without departing from its true spirit. Therefore, various changes and modifications obvious to those skilled in the art will fall within the scope of the present invention.

The invention claimed is:

1. A sucker for an adhesion arrow comprising:

a dome-shaped adhesion portion made of a flexible material having resiliency, the adhesion portion including an adhesion surface having a concave shape and a substantially circular boundary to generate a vacuum when the adhesion surface comes into hermetical contact with a flat surface of a target and an annular projection protruding by a predetermined width and height from the adhesion surface along a position with a predetermined radius from the center of the adhesion surface;

a fixing portion extending from a back surface of the adhesion portion; and an inclined surface extending from a boundary of the adhesion surface to a boundary of the back surface such that the diameter of a cross section of the sucker increases to have a shave of a truncated cone, thereby absorbing an impact when the adhesion surface comes into contact with the flat surface.

2. The sucker according to claim 1, wherein the flexible material having the resiliency is silicone resin.

3. An adhesion arrow, comprising;

the sucker with the annular projection formed on the adhesion surface according to claim 2; and an air propulsion member including a sucker fixing portion having a sucker fixing hole formed in a face of an end thereof to fixedly receive the fixing portion of the sucker, and a propulsion vane portion having the shape of a hollow funnel of which the diameter increases towards the other end of the sucker fixing portion.

4. The sucker according to claim 2, further comprising:

an annular projection formed on an outer circumferential surface of the fixing portion.

5. An adhesion arrow, comprising;

the sucker with the annular projection formed on the adhesion surface according to claim 4; and an air propulsion member including a sucker fixing portion having a sucker fixing hole formed in a face of an end thereof to fixedly receive the fixing portion of the sucker, and a propulsion vane portion having the shape of a hollow funnel of which the diameter increases towards the other end of the sucker fixing portion.

6. An adhesion arrow, comprising;

the sucker with the annular projection formed on the adhesion surface according to claim 1;

an air propulsion member including a sucker fixing portion having a sucker fixing hole formed in a face of an end thereof to fixedly receive the fixing portion of the sucker, and a propulsion vane portion having a shape of a hollow funnel of which the diameter increases towards the other end of the sucker fixing portion; and a sucker supporting member including a circular ring portion fixedly fitted around an outer circumferential surface of the sucker fixing portion of the air propulsion member and supporting portions formed on an outer circumferential surface of the ring portion at a predetermined angular interval, each of the supporting portions protruding by a predetermined length and width in an axial direction and in a direction perpendicular thereto, wherein the length from the center of the supporting portion to the tip thereof is longer than the radius of the adhesion portion of the sucker but shorter than a largest diameter of the propulsion vane portion of the air propulsion member.

* * * * *